US009573710B2

(12) United States Patent
Hendricks

(10) Patent No.: US 9,573,710 B2
(45) Date of Patent: Feb. 21, 2017

(54) OVERHEAD PACKAGING MACHINE WITH ARTICULATING LUGS

(71) Applicant: Graphic Packaging International, Inc., Marietta, GA (US)

(72) Inventor: Timothy W. Hendricks, Acworth, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 663 days.

(21) Appl. No.: 13/660,189

(22) Filed: Oct. 25, 2012

(65) Prior Publication Data

US 2013/0111855 A1 May 9, 2013

Related U.S. Application Data

(60) Provisional application No. 61/555,538, filed on Nov. 4, 2011.

(51) Int. Cl.
*B65B 11/00* (2006.01)
*B65B 41/08* (2006.01)
(Continued)

(52) U.S. Cl.
CPC ..... *B65B 11/004* (2013.01); *B65B 11/08* (2013.01); *B65B 41/04* (2013.01); *B65B 41/08* (2013.01);
(Continued)

(58) Field of Classification Search
CPC ..... B65B 21/24; B65B 21/242; B65B 43/126; B65B 11/004; B65B 11/08–11/16; B65B 49/02–49/16; B65B 11/06; B65B 41/02–41/08; B65B 41/18; B65B 43/165; B65B 45/00; B65B 21/245; B65B 21/247; B65G 2201/0244
(Continued)

(56) References Cited

U.S. PATENT DOCUMENTS 3,061,985 A * 11/1962 Ganz ..... 53/48.7
3,127,720 A 4/1964 Gentry et al.
(Continued)

FOREIGN PATENT DOCUMENTS

FR 1 347 478 A 12/1963
JP 9-255123 9/1997
(Continued)

OTHER PUBLICATIONS

International Search Report and Written Opinion for related application, No. PCT/US2012/061804, mailed Mar. 19, 2013.
(Continued)

*Primary Examiner* — Stephen F Gerrity
*Assistant Examiner* — Joshua Kotis
(74) *Attorney, Agent, or Firm* — Womble Carlyle Sandridge and Rice LLP

(57) ABSTRACT

An overhead packaging machine with articulating lugs is mountable along a product packaging system for the application of cartons such as wrap-style cartons about sets or groups of products. The overhead packaging machine includes a lug conveyor having a series of articulating lug assemblies mounted thereto and which are moved along a path of travel for engaging the groups of products with their cartons applied thereto. Each of the articulating lug assemblies includes a pair of articulating lugs mounted to a carriage, which articulating lugs are moveable into engaging positions for engaging the cartons applied to the groups of products as the groups of products are moved along their path of travel for folding and locking of the cartons thereabout. After the cartons have been applied and secured about their product groups, the articulating lugs can be moved to non-engaging positions, out of engagement with the cartons and/or product groups as the packaged product groups are moved away from the overhead packaging machine, while
(Continued)

the articulating lug assemblies can be moved along a return path of travel for engaging a next product group.

23 Claims, 8 Drawing Sheets

(51) Int. Cl.

| | |
|---|---|
| ***B65B 45/00*** | (2006.01) |
| ***B65B 41/04*** | (2006.01) |
| ***B65B 43/12*** | (2006.01) |
| ***B65B 49/02*** | (2006.01) |
| ***B65B 11/08*** | (2006.01) |
| *B65B 21/24* | (2006.01) |

(52) U.S. Cl.
CPC ..... *B65B 43/126* (2013.01); *B65B 45/00* (2013.01); *B65B 49/02* (2013.01); *B65B 21/242* (2013.01)

(58) Field of Classification Search
USPC ..... 53/48.6–48.9, 461–466, 443, 445, 398,53/207–209
See application file for complete search history.

(56) References Cited

U.S. PATENT DOCUMENTS

| | | | | | |
|---|---|---|---|---|---|
| 3,295,291 | A | * | 1/1967 | Wood | B65B 11/105 53/209 |
| 3,509,684 | A | * | 5/1970 | Scribner | B65B 17/025 493/309 |
| 3,643,796 | A | | 2/1972 | Arneson | |
| 3,766,704 | A | * | 10/1973 | Ganz | 53/48.7 |
| 3,900,096 | A | | 8/1975 | Nack et al. | |
| 4,501,104 | A | | 2/1985 | Griffin et al. | |
| 4,590,745 | A | | 5/1986 | Randles | |
| 4,982,551 | A | | 1/1991 | Nigrelli, Sr. | |
| 5,154,041 | A | | 10/1992 | Schneider | |
| 5,359,830 | A | | 11/1994 | Olson et al. | |
| 5,469,687 | A | | 11/1995 | Olson | |
| 5,501,318 | A | * | 3/1996 | Disrud | 198/732 |
| 5,546,734 | A | * | 8/1996 | Moncrief et al. | 53/534 |
| 5,592,804 | A | * | 1/1997 | Reuteler | 53/398 |
| 5,626,002 | A | * | 5/1997 | Ford et al. | 53/398 |
| 5,638,659 | A | * | 6/1997 | Moncrief et al. | 53/448 |
| 5,653,084 | A | * | 8/1997 | Mueller | 53/48.7 |
| 5,673,536 | A | * | 10/1997 | Easter et al. | 53/398 |
| 5,724,785 | A | * | 3/1998 | Malanowski | 53/48.1 |
| 5,809,746 | A | * | 9/1998 | DePuy | 53/458 |
| 6,279,301 | B1 | | 8/2001 | Corniani et al. | |
| 6,505,458 | B1 | * | 1/2003 | Corniani et al. | 53/462 |
| 6,550,608 | B1 | | 4/2003 | Brown et al. | |
| 6,575,886 | B1 | | 6/2003 | Tanck et al. | |
| 6,732,489 | B1 | | 5/2004 | Hawley | |
| 8,083,061 | B2 | | 12/2011 | Fogel et al. | |
| 2001/0032775 | A1 | * | 10/2001 | Guglielmo et al. | 198/732 |
| 2007/0220836 | A1 | * | 9/2007 | Reuteler | B31B 1/78 53/491 |
| 2013/0042580 | A1 | * | 2/2013 | May et al. | 53/457 |

FOREIGN PATENT DOCUMENTS

| | | |
|---|---|---|
| JP | 11-506078 | 6/1999 |
| WO | WO 97/21592 | 6/1997 |

OTHER PUBLICATIONS

Supplementary European Search Report for EP 12 84 4924.6 dated Mar. 13, 2015.
Notification of Reasons for Refusal for JP 2014-539989 dated Aug. 15, 2016, with English translation.

* cited by examiner

OVERHEAD PACKAGING MACHINE WITH ARTICULATING LUGS

CROSS REFERENCE TO RELATED APPLICATIONS

The present patent application is a formalization of previously filed, U.S. Provisional Patent Application Ser. No. 61/555,538, filed Nov. 4, 2011 by the inventors named in the present application. This patent application claims the benefit of the filing date of this cited Provisional patent application according to the statutes and rules governing provisional patent applications, particularly 35 U.S.C. §119(a)(i) and 37 C.F.R. §1.78(a)(4) and (a)(5). The specification and drawings of the Provisional patent application referenced above are specifically incorporated herein by reference as if set forth in its entirety.

FIELD OF THE INVENTION

The present invention generally relates to systems and methods for packaging various types of products, and in particular to a packaging machine and method of operation thereof for the application of wrap-style cartons about groups of products.

BACKGROUND OF THE INVENTION

Products such as bottles, cans, and packaged food containers such as yogurt cups or tubs, and/or other products typically are packaged together in groups such as six-packs, twelve packs, twenty-four-packs, etc., for ease of shipment and purchase. Such product packages typically include sleeve-type cartons in which a carton blank is folded and glued to form an open-ended tube or sleeve into which the groups of products are inserted and the ends of the cartons sealed, and wrap-style cartons, which typically are applied to groups of products or articles placed on the flat carton blank which is then folded and locked about the group of products. In recent years, greater emphasis has been placed on attempting to reduce the size of product packaging, as even incremental reductions in the amount of packaging materials, such as paperboard, plastics, etc., can lead to significant reductions in the overall cost of the packaging of products.

In particular, efforts have been made to develop so-called "econo" style cartons that are of a reduced length or size, typically extending only partially along the outermost products in a group of products being packaged, such that a significant reduction in the materials required for such packages is realized. Reducing the size of the product package to substantially less than the overall length of the product grouping to be packaged has, however, previously required such packages be applied manually to the product groups, which slows production significantly. Alternatively, for use in automated packaging systems, such reduced size cartons generally have had to be pre-formed and pre-glued into a sleeve-type carton in which the product groups are later inserted. To facilitate the insertion of the product groups, however, it is necessary that such sleeve-type cartons be slightly oversized to enable the product groups to be easily inserted therein, after which product locking features further must be engaged so as to secure the products within the carton, generally requiring additional steps in the packaging operation for the products, thus slowing production rates.

Accordingly, it can be seen that a need exists for a system and method for packaging products in groups that addresses the foregoing and other related and unrelated problems in the art.

SUMMARY OF THE INVENTION

Briefly described, the present invention generally relates to a system for packaging groups of products moving along a path of travel wherein cartons, such as "wrap-style" cartons which can have a dimension or configuration less than the groups of products to which they are applied, are moved in conjunction with the groups of products for wrapping of the cartons about the groups of products. The system of the present invention generally includes an overhead packaging machine or system mounted within a product packaging system extending along a product conveyor along which the groups of products are moved, with cartons applied thereto, for folding and wrapping of the cartons about the groups of products.

The overhead packaging machine generally includes a lug conveyor section that is mounted to an adjustable frame and has a lug conveyor that carries of series of articulating lug assemblies about an elliptical path into and out of engagement with the groups of products and the cartons applied thereover. In addition, folding rods generally are mounted along the path of travel of the products, adapted to progressively engage and urge the side portions of the cartons downwardly toward a folded, wrapped configuration or position about the sides of the groups of products to which they are applied. Thereafter, locking elements of the cartons can be engaged by locking mechanisms of the packaging system to enclose the cartons about their groups of products.

Each of the articulating lug assemblies generally will include a carriage to which a pair of articulating lugs can be mounted. Each of the articulating lugs generally includes a body that can be pivotally mounted to the carriage and which includes a cam pin or rod affixed to and/or projecting from an upper portion of the body. A product pusher element also can be mounted between the articulating lugs mounted on either side of each carriage, for engaging and helping to urge the groups of products along their path of travel. First and second cam tracks generally can be formed along upper and lower runs of the lug conveyor section of the overhead packaging machine, with the cam surfaces of each of the first and second cam tracks generally being formed at different, varying orientations or angles.

As the cam pins of the articulating lugs are moved along a first or innermost cam track, the articulating lugs generally can be maintained in a first, non-engaging or raised position. As the articulating lug assemblies move along the lower run of the lug conveyor section, the cam pins of their articulating lugs each can be transitioned to outermost or second cam tracks, causing the articulating lugs to be moved or pivoted downwardly toward a second, engaging or lowered position in which the bodies of the articulating lugs can engage the cartons applied to the groups of products. As a result, as the pusher elements of each of the articulating lug assemblies engage and move the groups of products, the cartons applied to such groups of products correspondingly are engaged and urged along the path of travel in conjunction with the movement of the products so as to maintain the alignment of each carton with the group of products to which it is applied as the cartons are folded and locked about their groups of products.

As the articulating lug assemblies approach a downstream end of the lower run of the lug conveyor section, their cam pins can be transitioned from the second or outermost cam tracks to the first or innermost cam tracks. As the cam pins of the articulating lugs move along the first or innermost cam tracks, the articulating lugs can be caused to pivot or move toward their non-engaging or raised positions out of engagement with the cartons and/or the groups of products. As the groups of products thereafter are removed from the product packaging system, the articulating lug assemblies can be returned along the upper run of the lug conveyor section back toward the forward or upstream end thereof for engaging a next group of products.

Various features, advantages and objects of the present invention will become apparent to those skilled in the art upon a review of the following detailed description, when taken in conjunction with the accompanying drawings.

DETAILED DESCRIPTION

Figure 1:
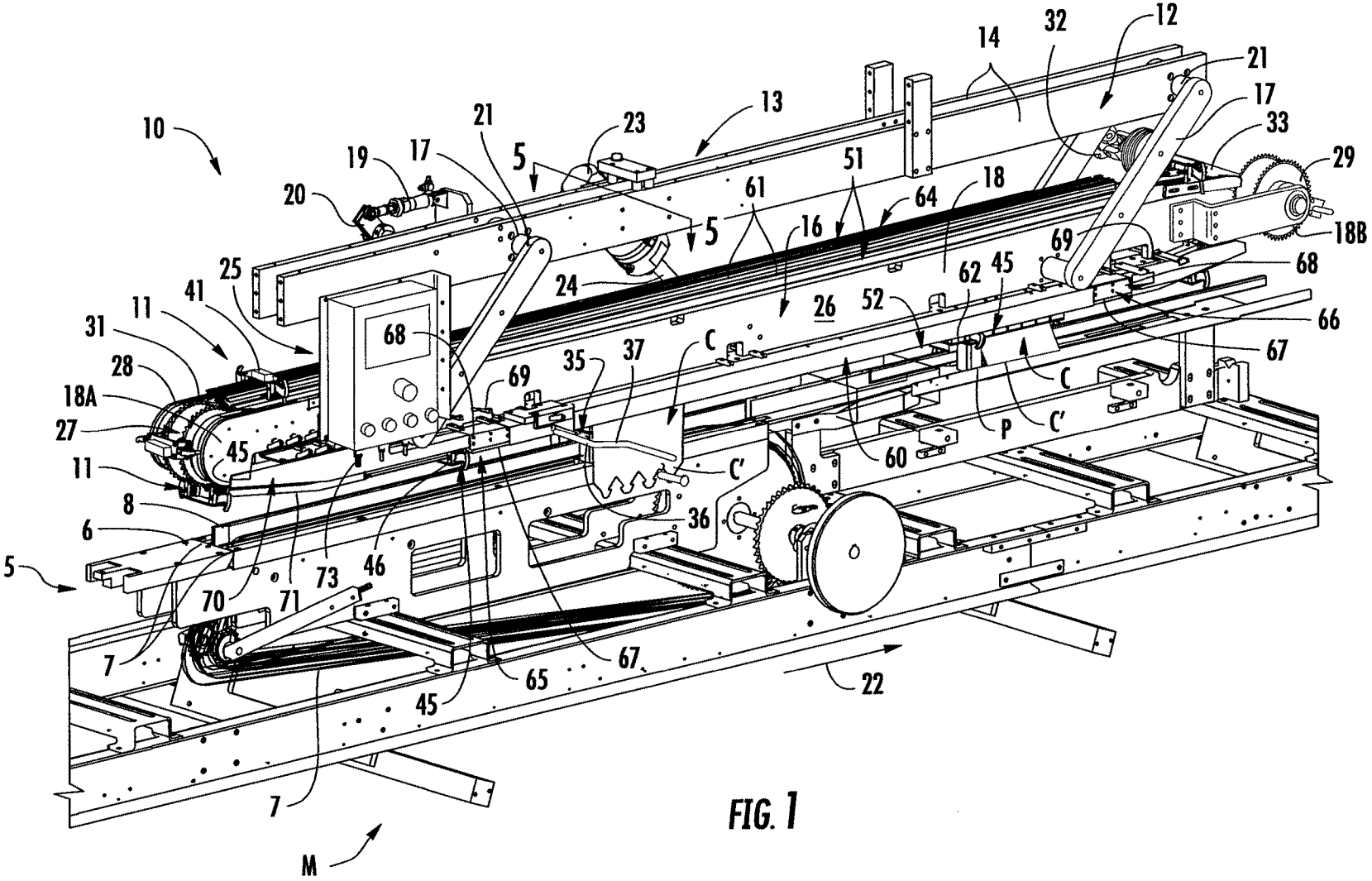
FIG. 1 is a perspective illustration of one embodiment of a packaging system incorporating an overhead packaging machine with articulating lugs according to the principles of the present invention.

Referring now to the drawings in which like numerals indicate like parts throughout the several views, FIGS. 1-5 generally illustrate the overhead packaging machine 10 with articulating lug assemblies 11 according to one embodiment of the present invention. The overhead packaging machine 10 generally is adapted to function as an add-on or change-out attachment/section for existing wrap-style packaging machines, for example, a Marksman packaging machine or system M as manufactured by Graphic Packaging International, Inc., and can be configured to run varying size wrap-style cartons, including reduced size or "econo" type wrap-style cartons, as well as conventional, full size wrap-style cartons or other packaging materials, by adjustment and/or change-out of the articulating lug assemblies 11 of the overhead packaging machine 10. As indicated in FIGS. 1-2 and 4-6B, in one example embodiment of the present invention, the cartons C being wrapped or applied about a group of products P are shown as being of a reduced length that extends less than the full length of the group of products P, so as to only partially engage or fold about a portion of the end-most products P' (FIGS. 6A-6B) of the group of products to which the carton C is being applied. For example, the products can include bottles, cans, or other types of packaged materials, such as 6-8 pack yogurt tubs or cups, although other products also could be similarly packaged including multiple stacks or layers of such packages such as in 12-16 pack bulk stacked packs, and can be wrapped with cartons C having reduced lengths or sizes, such as "econo" style cartons having reduced dimensions or lengths or set back from the ends of the product packages by ½ a product width or diameter, although other spacings or reductions in carton sizes also can be used.

Figure 3A:
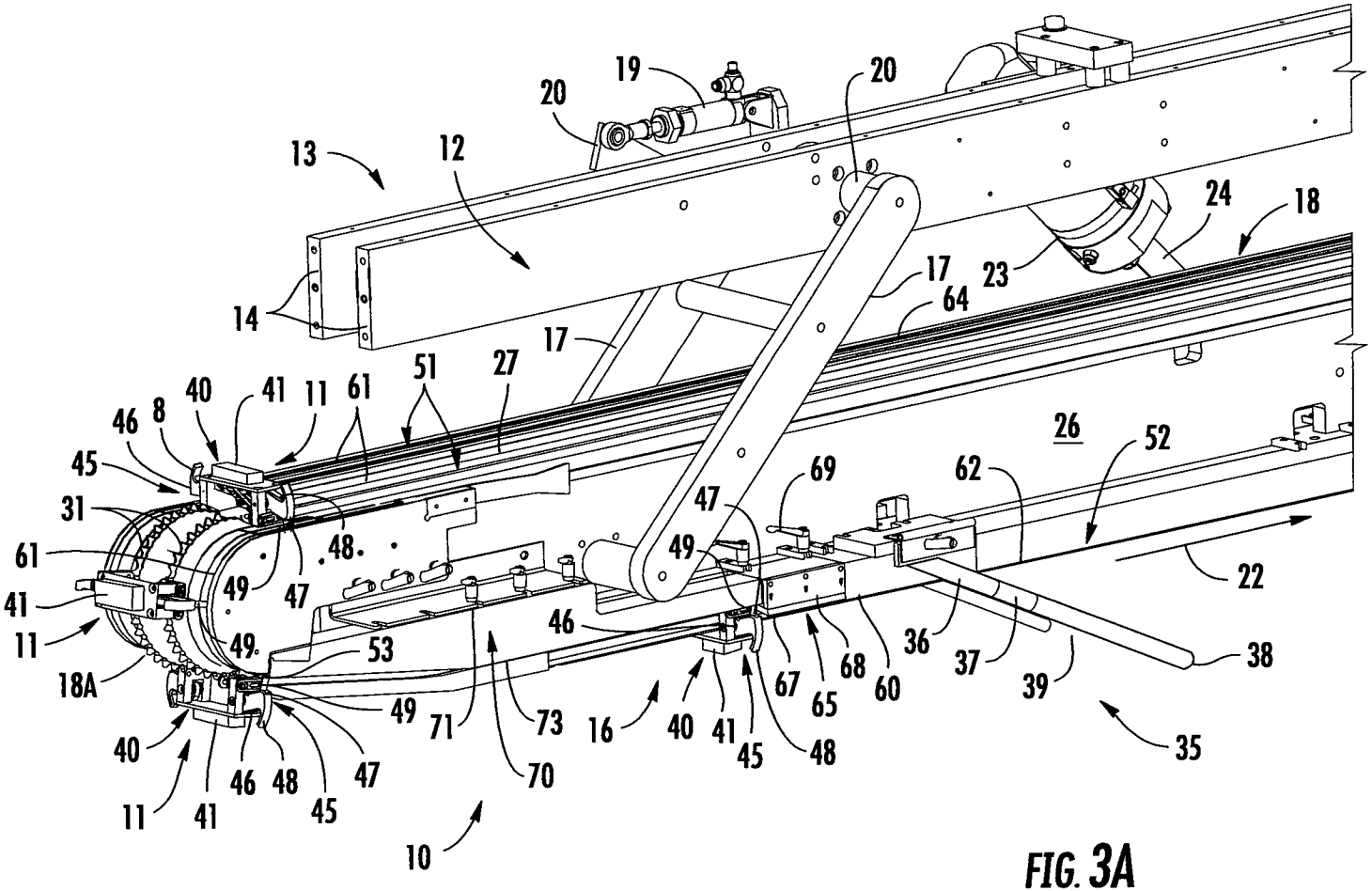
FIGS. 3A-3B are perspective illustrations of one end of the overhead packaging machine with articulating lugs of FIGS. 1-2.
Figure 3B:
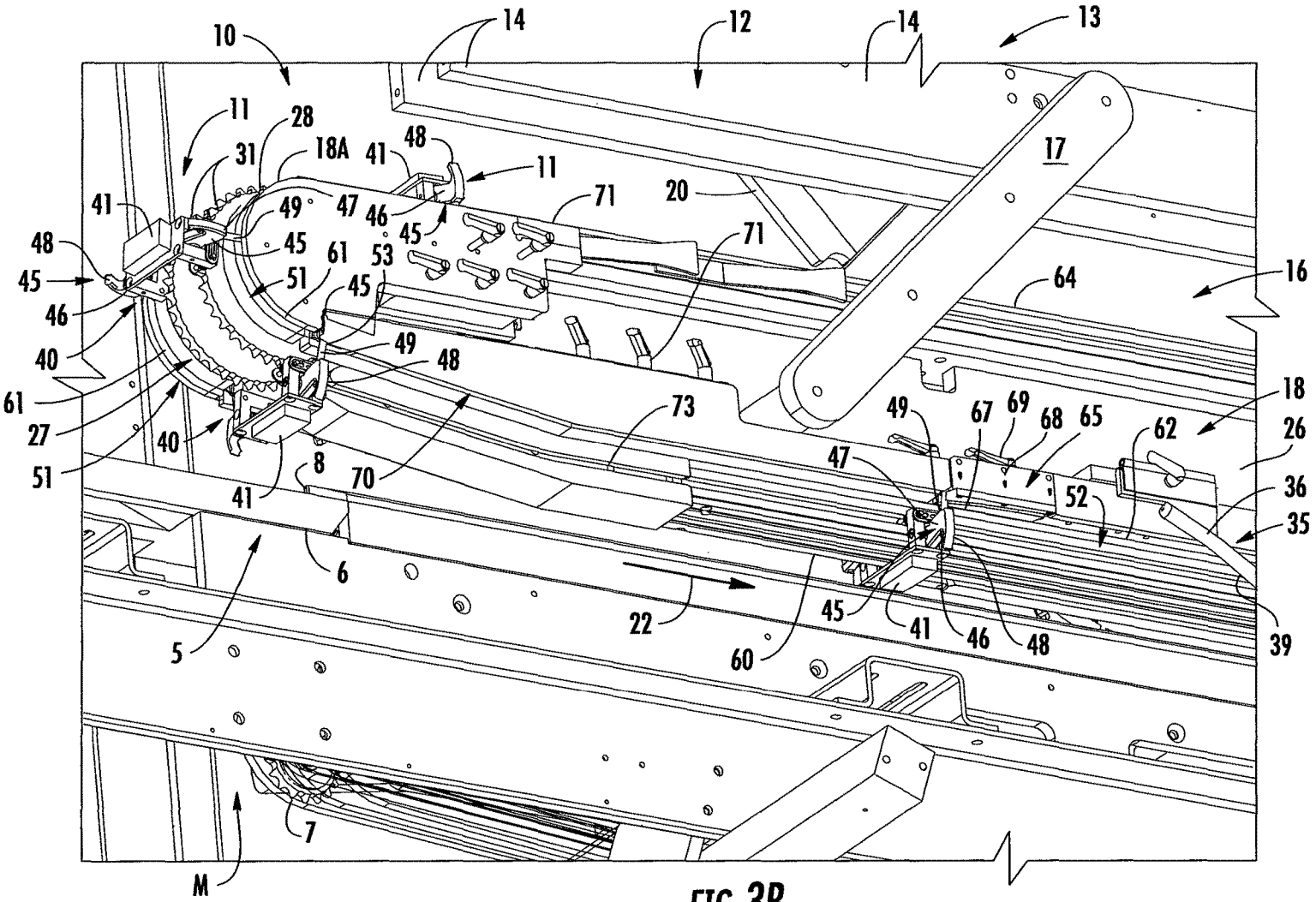

As illustrated in FIGS. 1 and 3B, the overhead packaging machine 10 generally can be mounted over a product conveyor line or mechanism 5 (FIG. 1) of the packaging system M. Such a product conveyor 5 generally can comprise a lug conveyor 6 having a series of lugs or pushers driven by belts or chains, as indicated at 7 in FIG. 1, for urging/moving the products P along their path of travel 22 for packaging. A guide 8 further can be mounted along the lug conveyor 6 for guiding and helping to maintain the alignment and orientation of the products as they are moved along their path of travel for wrapping of the cartons C thereabout.

Figure 2:
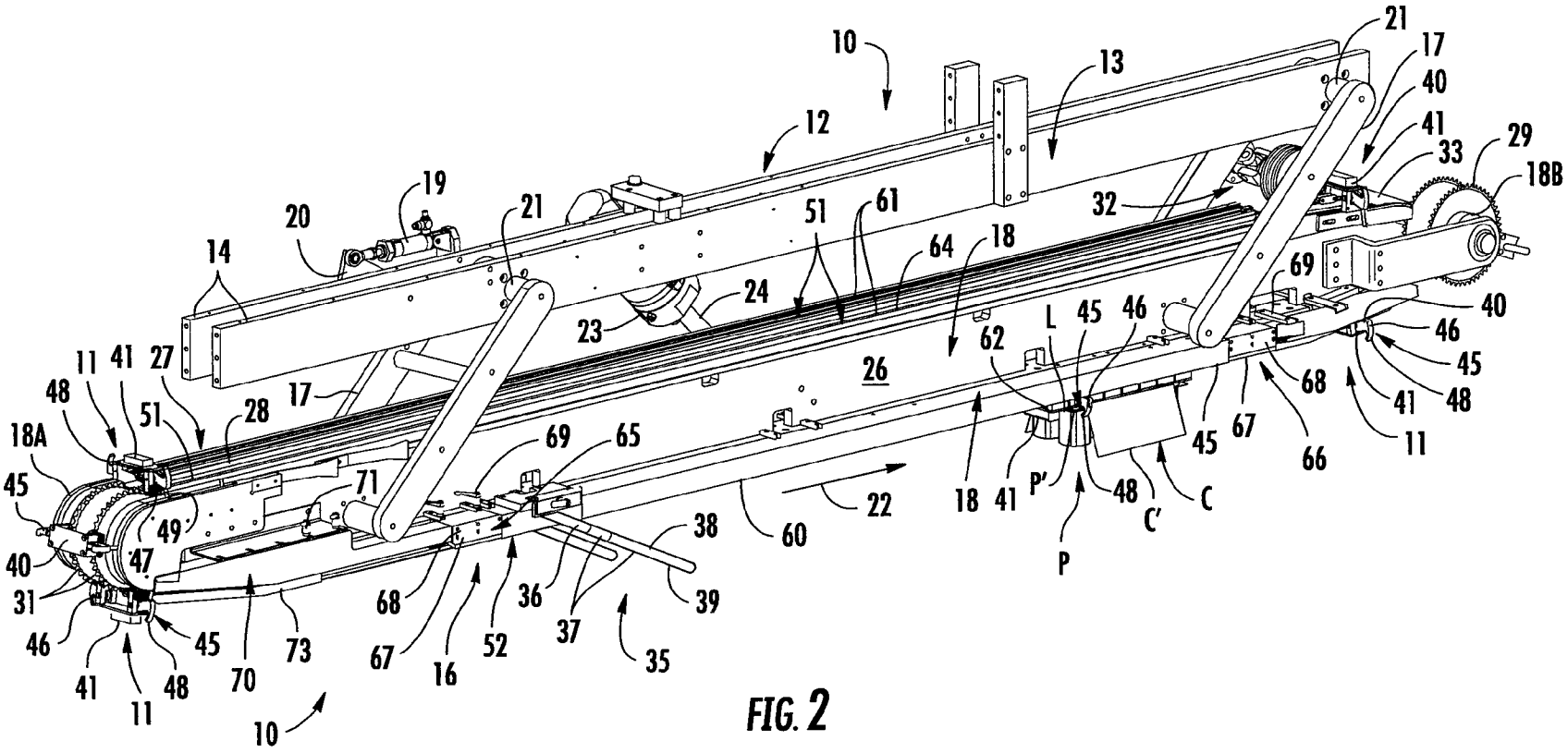
FIG. 2 is a perspective view of the overhead packaging machine of FIG. 1.
Figure 4:
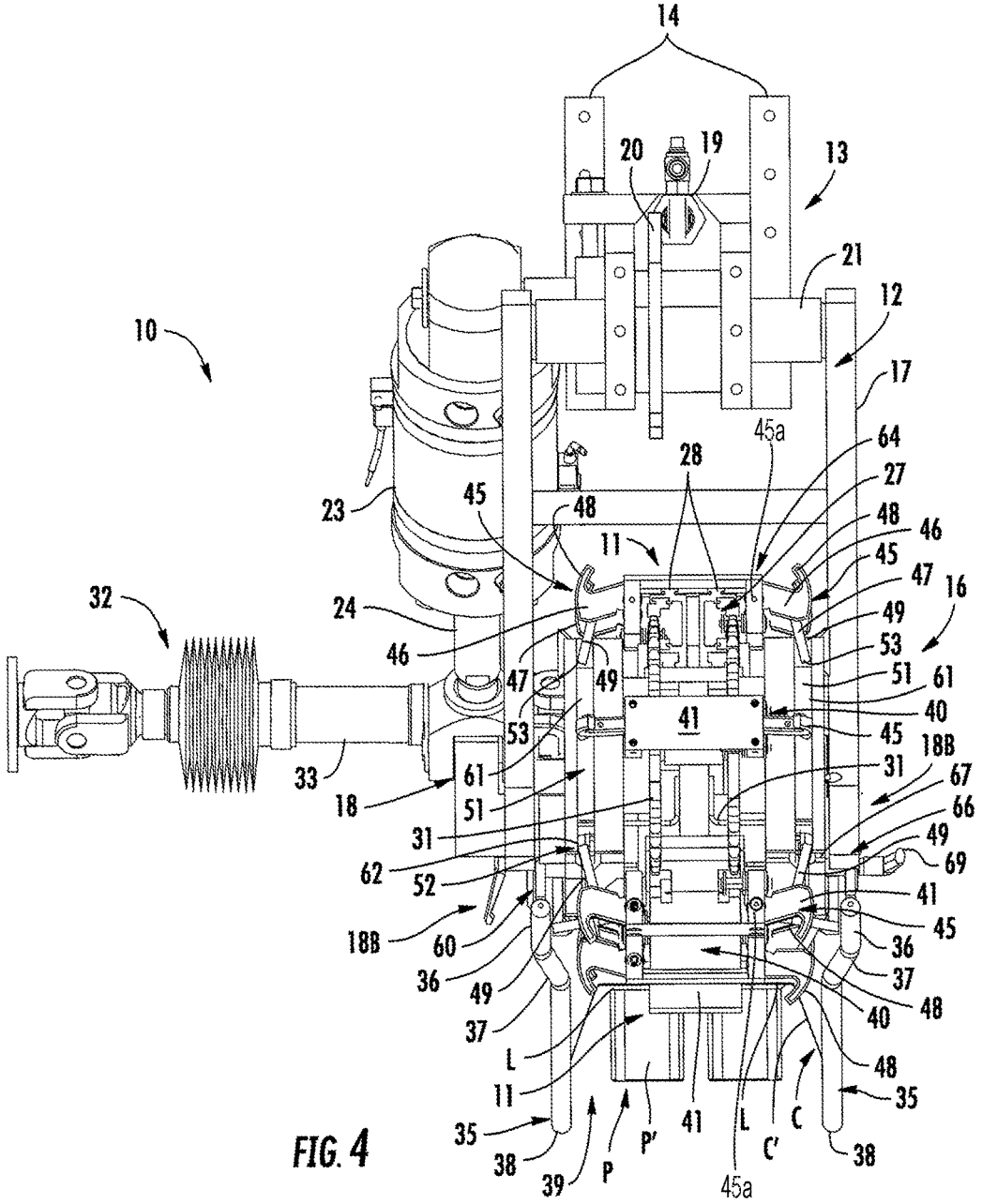
FIG. 4 is an end view of the overhead packaging machine with articulating lugs of FIGS. 1 and 2.

As FIGS. 1 and 2 illustrate, the overhead packaging machine 10 generally includes an elongated frame assembly 12, comprising an overhead mounting section 13, shown in FIG. 1 as including one or more spaced mounting rails 14 that can be secured to an overhead support, and a lower drive or lug conveyor section 16 supported by the overhead mounting section 13. Pivoting support brackets 17 generally are attached to the rails 14 of the overhead mounting section and to a sub-frame assembly 18 of the lug conveyor section 16. As illustrated in FIGS. 1-3A and 4, an actuator 19, such as a pneumatic cylinder or motor, can be mounted to the overhead mounting section and is coupled by a linkage 20 of one of the pivoting support brackets 17, as shown in FIG. 4, so as to cause the pivoting or swinging motion of at least one of the support brackets about pivot rods 21 as needed for adjusting the longitudinal position of the lug conveyor section of the overhead packaging machine with respect to a path of travel of the products P, indicated by arrow 22, (FIG. 1) along the product conveyor 5 of the packaging system M to which the overhead packaging machine 10 is mounted. In addition, a separate actuator 23, such as a cylinder or motor also can be provided along one side of the frame assembly 12 of the overhead packaging machine 10 and can include an extensible cylinder rod 24 or similar mechanism connected to the sub-frame assembly 18 of the lug conveyor section 16. The actuator 23 can be operated for controlling the vertical position and thus the vertical spacing of the lug conveyor section 16 with respect to the products moving along their path of travel 22 along the product conveyor 5 of the packaging system M.

As illustrated in FIGS. 1-4, the sub-frame assembly 18 of the lug conveyor section 16 of the overhead packaging machine 10 generally includes side plates 26 and a lug conveyor 27 extending in an elliptical path along the length of the lug conveyor section. The lug conveyor 27 typically can include spaced chains 28, belts or other similar driving elements, that extend along the path of travel 22 of the products P (FIGS. 1-2 and 4), and about pairs of sprockets 29 and 31 mounted at the opposite upstream and downstream ends 18A/18B of the sub-frame assembly, as indicated in FIGS. 1-2. One of the sprockets 29 typically will be driven by a drive assembly 32 (FIG. 4), which can include a drive shaft 33 connected to a variable speed motor or similar drive to cause the chains 28 of lug conveyor 27, and thus the articulating lug assemblies 11 mounted thereto, to be driven along the path of travel 22 of the products P at varying rates for engaging and feeding various size and/or configuration product groups and cartons. The positioning/location of the overhead packaging machine and operation of the lug conveyor can be controlled via an operator or system control, such as indicated at 25 in FIG. 1.

As additionally illustrated in FIGS. 1-3A, folding rods 35 can be mounted along the sub-frame assembly 18 of the lug conveyor section 16 adjacent the upstream end 18A thereof. Each of the folding rods 35 generally is mounted in a downwardly extending orientation and can include an upstream or entry section 36, an inwardly angled intermediate section 37, and a narrowed distal or rear section 38, as shown in FIG. 3A. As indicated in FIGS. 1 and 3A, the groups of products P, with the cartons C applied thereto, enter the passage 39 defined between the folding rods 35, the sides C' of the cartons C contact/engage the folding rods 35. This contact/engagement with the folding rods causes the sides C' of the cartons to be progressively urged downwardly and inwardly toward the sides of the product groups thus folding the carton thereabout as indicated in FIGS. 4-6B.

As illustrated in the FIGS. 1-6B, a series of articulating lug assemblies 11 generally will be mounted at spaced or pitched arrangements along the chains of the lug conveyor. Each of the articulating lug assemblies 11 generally will include a carriage 40 mounted to the spaced chains 28 (FIGS. 4-5) and including a product pusher element 41 adjacent a rear or distal portion thereof. The product pusher element 41 generally can be formed from a lightweight, durable material such as a plastic material, and typically will engage the endmost products P' of the product group, so as to urge the products forwardly along their path of travel 22 as indicated in FIGS. 1, 2 and 6A-6B, while at the same time, the carton C applied to the group of products will be urged along the path of travel 22, by articulating lugs 45 in cooperative movement with the group of products.

Figure 5:
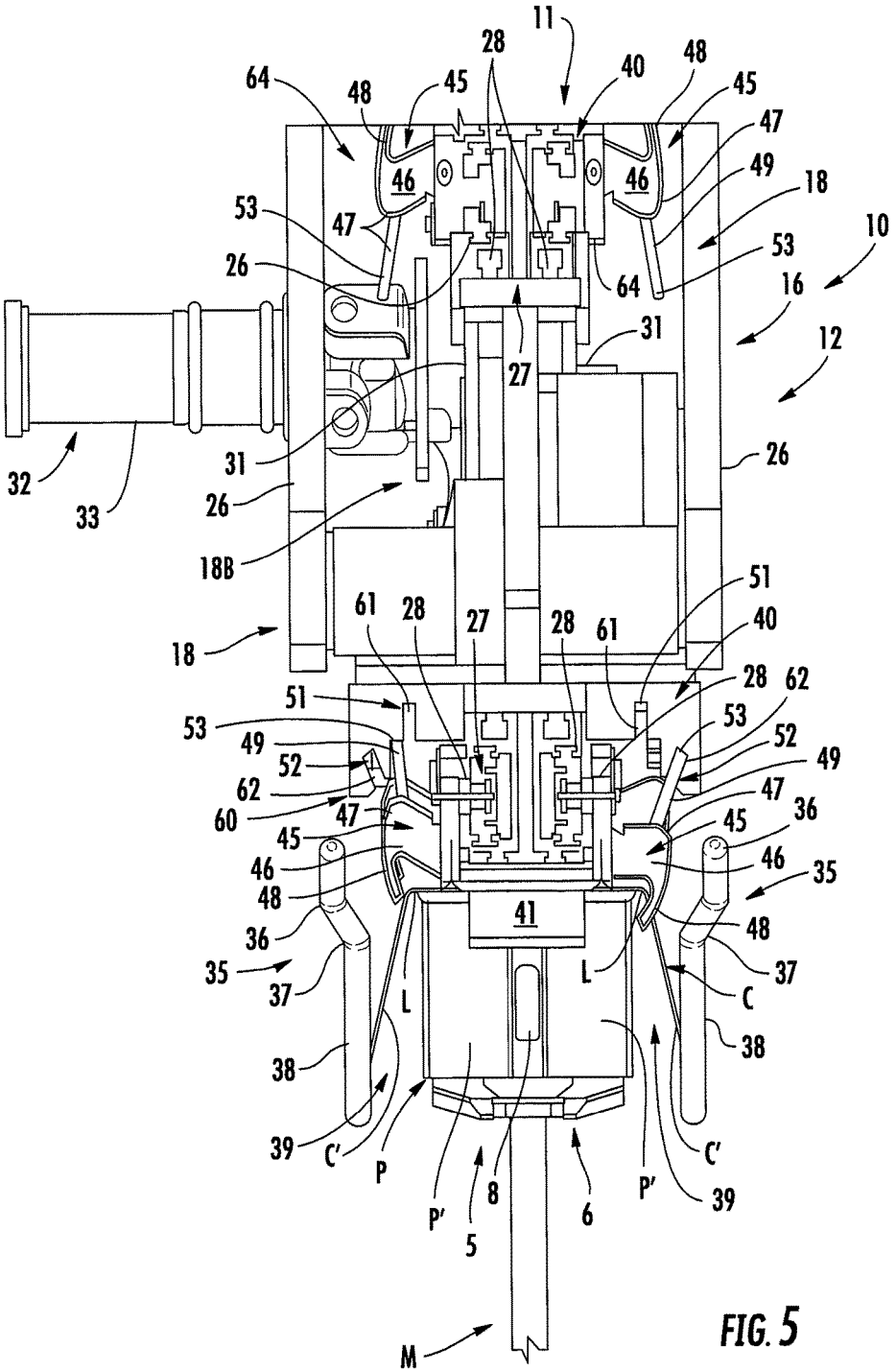
FIG. 5 is a further end view, taken in cross section along lines 5-5 of FIG. 1, illustrating the engagement of the cam rods of the articulating lugs with cam tracks extending along the overhead packaging machine with articulating lugs.

As indicated in FIGS. 3A-6B, each of the articulating lugs 45 generally will be pivotally mounted to its carriage 40, with there typically being at least one articulating lug 45 on each side of the carriage 40. Each articulating lug further generally will include a body 46 formed from a rigid, durable material with an upper portion 47 and a curved downwardly projecting lower hooked engaging portion 48. A cam rod or pin 49 (FIG. 4) will be mounted to the upper portion 47 of each articulating lug 45, projecting upwardly therefrom. The cam rods 49 of the articulating lugs 45 generally can be of varying lengths and each will engage one of a pair of cam tracks 51/52 mounted on opposite sides of the chain conveyors 27 as indicated in FIGS. 3B and 5, for controlling the pivoting movement and thus the position of the articulated lugs 45.

As each distal end 53 of the cam pins or rods of each of the articulating lugs moves along its respective cam track 51/52, the articulating lugs can be caused to move between raised, first or non-engaging positions, and second or lowered, engaging positions, with the lower or hooked engaging portion 48 of each of the articulating lugs 45 tending to be curled under a lip or edge L of the rearmost products P' of the product group being engaged thereby, as shown in FIGS. 4-6B. Such pivoting movement of the articulating lugs enables the lugs to be moved to a position or location where they can remain in operative, pushing engagement with the carton, but will not interfere with the folding rods 35 and/or the carton engaging/locking mechanisms of the packaging system M as the cartons are folded and locked about their product groups, and thereafter enables the actuating lugs 45 to be raised to a non-engaging position out of contact with the cartons and the products being packaged.

FIG. 3B illustrates one example embodiment of the arrangement of the first and second cam tracks 51 and 52 of each pair of cam tracks extending along the lug conveyor section 16 of the overhead packaging machine. The cam tracks generally are spaced apart from each other as they extend along the lower run 60 of the lug conveyor section 16, and can be formed with cam surfaces 61/62 respectively, having differing slopes or orientations. For example, as shown in FIG. 5, the cam surfaces 62 of the second or outermost cam tracks 52 of each pair of can tracks generally can be oriented at an angle with respect to the path of travel 22; while the cam surfaces 61 associated with the first or inner cam tracks 51 generally can be substantially parallel with the path of travel 22 of the products and articulating lug assemblies 11, or arranged in another orientation as needed for maintaining the articulating lugs in their non-engaging positions as shown in FIG. 5.

Figure 6A:
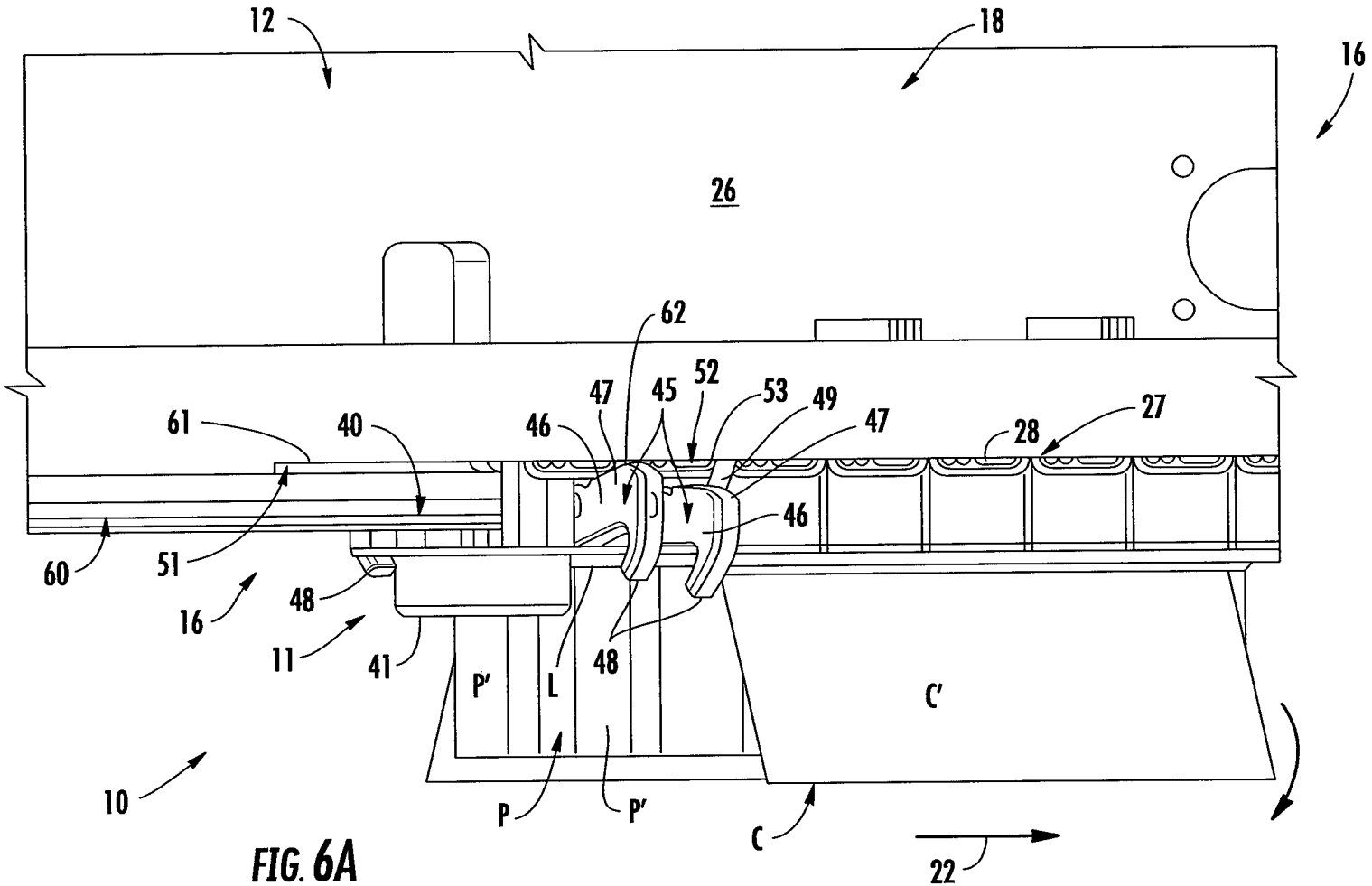
FIG. 6A is a perspective view illustrating sequential engagement of the articulating lugs and product pusher element.
Figure 6B:
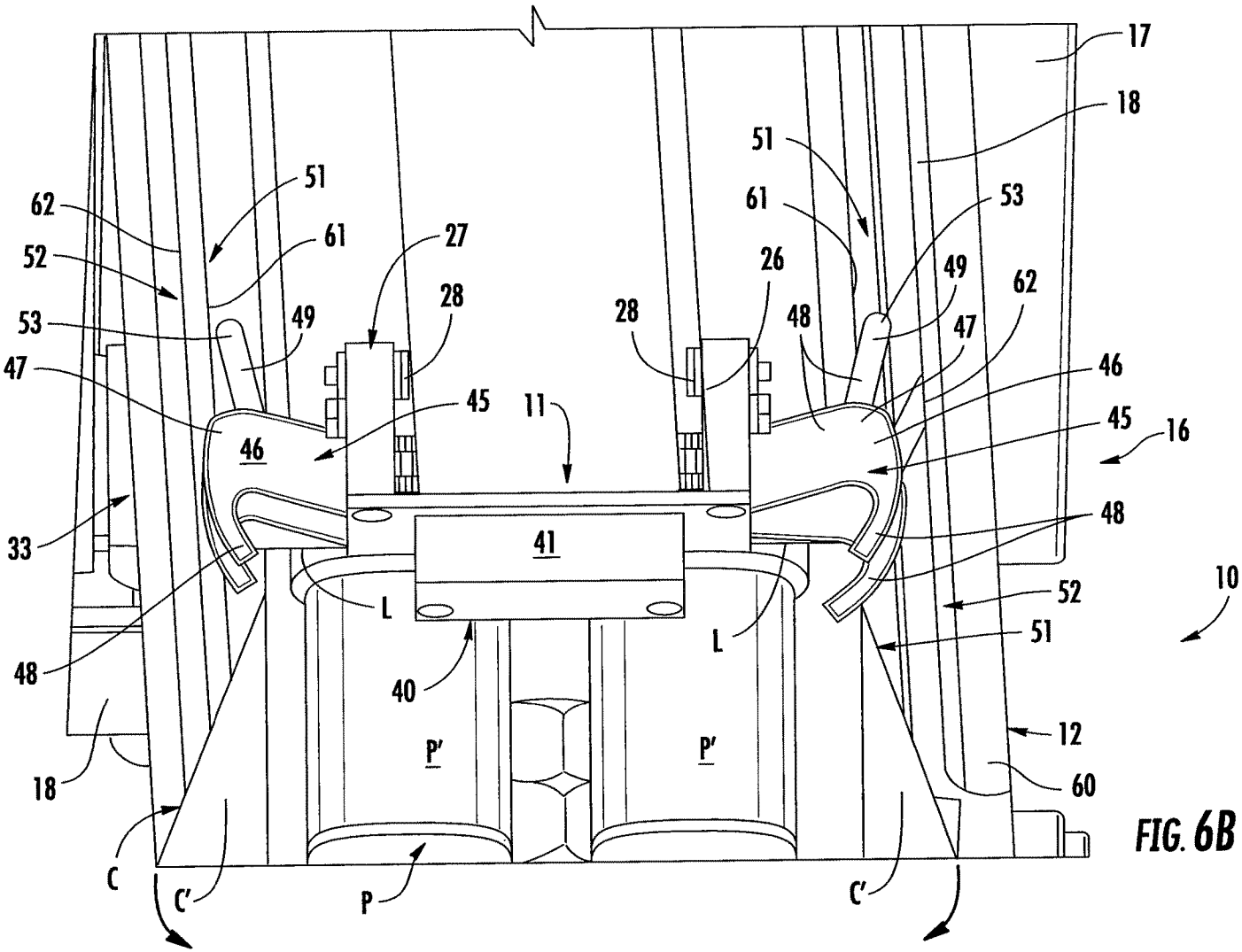
FIG. 6B is a perspective illustration of a product group being engaged by the product pusher element and the articulating lugs, illustrating the engagement of the cam rods of the articulating lugs within the overhead cam tracks.

The outermost cam tracks 52 of each pair of cam racks further can be provided along only the lower run 60 of the lug conveyor section 16 as needed, with the cam pins 49 of the articulating lugs 45 being selectively engaged with either first cam track 51 or second cam track 52 to control positioning of the articulating lugs in their first raised or non-engaging position shown in FIGS. 6A-6B or lowered second or engaging position as shown in FIGS. 4 and 6A, with the hooked lower portion 48 of each articulating lug 45 fitting under the lid L of products P, and with the lugs of each carriage engaging a rear or trailing edge of the carton for moving the carton C in conjunction with the group of products to which it is applied. The innermost or first cam track 51 generally can extend along both the lower run 60 and the upper run 64 of the lug conveyor section 16 to maintain control of the cam pins 49 of the articulating lugs 45 as the articulating lugs are moved along their elliptical path about the lug conveyor section as indicated in FIGS. 4-5.

Transition guides 65 (FIGS. 3A-3B) and 66 (FIGS. 1-2) generally are mountable along the sub-frame 18 of the lug conveyor 16, adjacent the upstream and downstream ends thereof. As FIG. 3B illustrates, the transition guides each include a shortened transitional cam track section 67 within a mounting bracket 68. The mounting brackets can be releasably attached to side plates 26 such as by clamps, set screws or other fastening mechanisms 69 to enable change-out of the transition guides as needed. Alternatively, the track sections can be releasably mounted within their brackets 68 by fastening mechanisms 69 to enable change-out of cam track sections 67 as needed. The cam track section 67 of each transition guide extends between the first and second cam tracks 51 and 52 of each pair of cam tracks for transitioning the cam pins 49 of the articulating lugs 45 between the first or inner cam tracks 51 and the second or outer cam tracks 52. As the cam pins transition to the second cam tracks 52, the articulating lugs are caused to pivot toward their engaging positions into contact with the cartons as shown in FIGS. 5-6B, and as the cam pins 49 are transitioned back to the first or inner cam tracks 51, the articulating lugs are caused to pivot or move toward their non-engaging positions out of contact with the cartons C as indicated in FIG. 1.

In addition, a forward cam guide section 70 (FIGS. 1-3B) can be provided along the proximal or forward end 18A of the sub-frame 18 of the lug conveyor section 16. This forward cam guide section 70 can be formed as a change-part that can be mountable to the sub-frame 18 along the forward ends of side plates 26. For example, the forward cam guide section 70, and the transition guides 61, which likewise can be formed as change-parts, each can be releasably mountable along the side plates 26 by various fastening mechanisms 71, such as locking bolts, clamps, or other, similar releasable connectors. As shown in FIG. 3B, the forward cam guide section 70 further includes a cam track section 73 that generally comprises an extension of cam track 51, extending from the forward end 18A of sub-frame 18 to the transition guide 61 for guiding the cam pins 49 of the articulating lugs 45 to the transition guides.

The forward cam guide section 70 also can be removed/changed as needed to guide the cam pins of the articulated lugs along different paths. For example, for running full length cartons that substantially completely cover the product groups, the articulating lugs 45 may not be needed to move the cartons, and thus, the forward cam guide section 70 could be replaced with a cam track that maintains the cam pins within the first cam track 51, such that the articulating lugs maintained in a raised, non-engaging orientation. Thereafter, as needed for running smaller dimension cartons, the forward cam guide section 70 could be changed-out to provide for the transition of the cam pins of the articulating lugs to the second cam track 52.

During operation of the overhead packing machine 10 (FIG. 1) with articulating lug assemblies 11, after application of the carton C to the upper surface of a group of products P, the group of products will be urged forwardly with this movement along the product conveyor 5 by the product pusher element 41 of each of the lug assemblies 11. The articulating lugs 45 on each side of the articulating lug assemblies further generally will be lowered to an initial engaging position whereby they will engage the cartons so as to urge/move the carton forwardly at the same time as and in conjunction with the group of products being urged forwardly by the product pusher element 41. This operation is schematically illustrated in FIGS. 6A-6B, in which articulating lugs 45 are shown moving between their non-engaging and engaging positions. While two adjacent lugs are shown in FIGS. 6A-6B, it will be understood that these figures are schematically illustrating the movement of the lugs and only one set of articulating lugs (including one articulating lug mounted on each side carriage for engaging the cartons on each side of the group of products) is needed and generally will be used.

As shown in FIG. 1, as each group of products P and their applied cartons C approach the folding rods 35, the cam pins of the articulating lugs generally will be transitioned to and received along the second or outermost cam tracks 51. The cam pins are thus directed outwardly and are urged downwardly as they move along their respective second cam tracks 52, causing the articulating lugs 45 to be pivoted downwardly and inwardly toward the sides of the products, as indicated in FIGS. 5-6B. For example, the articulating lugs 45 may pivot about a pivot pin 45*a* (FIG. 4), and pivot about an axis that extends in a direction substantially parallel to the path of travel 22 (FIG. 6A). As a result, the articulating lugs are moved away from a position where they could engage the folding rods, while their contact with their engaged carton C is maintained as the product group also continues to move forwardly along its path of travel, as indicated by arrow 22 (FIGS. 6A-6B). Thereafter, the folding rods 35 will engage and progressively urge the sides C' of the carton C downwardly and inwardly toward the sides of the product grouping.

As the group of products, with its applied carton being at least partially folded thereabout, continues forwardly along its path of travel, the lower ends of the carton typically are engaged and further folded, and locking elements of the carton are engaged by folding and tab engaging mechanisms (not shown) of the packaging system M therebelow (FIG. 1) so as to lock or fix the carton in a secure position wrapped about the group of products. Thereafter, as the group of products with the carton wrapped thereabout approaches the distal or downstream end 18A of the overhead packaging machine 10, the cam pins of the articulating lugs are transitioned along transition guides 66 back to the first or inner cam tracks 51. As the cam pins move along the cam tracks of transition guides 66 and onto/along their cam tracks 51, the cam pins generally are urged upwardly and inwardly, which in turn causes the articulating lugs to be pivoted outwardly and upwardly, away from the sides of the product groups. This ensures that the articulating lugs will be displaced from engaging or otherwise interfering with the release of the wrapped products from the packaging machine as the articulating lug assemblies are rotated upwardly and moved along a return path of travel along the upper side of the lug conveyor section by the lug conveyor.

Those skilled in the art will appreciate and understand that, according to common practice, the various features of the invention shown in the drawings and discussed above are not necessarily drawn to scale, and that dimensions of various features and elements of the drawings may be expanded or reduced to more clearly illustrate the embodiments of the present invention described herein. In addition while the present invention is shown as packaging one example type of product grouping or pack, such as a 6-8 pack of attached yogurt containers or tubs in a single layer or row, other, varying size and configuration product cartons and packaging also can be run. For example, multiple rows or layers of stacked products, such as multiple rows of stacked yogurt tubs, cans, etc., also can be packaged utilizing the system of the present invention.

The foregoing description generally illustrates and describes various embodiments of the present invention. However, it will be understood by those skilled in the art that various changes can be made to the above-discussed construction without departing from the spirit and scope of the present invention as disclosed herein, and that it is further intended that all matter contained in the above description or shown in the accompanying drawings shall be interpreted as illustrative, and not in a limiting sense. Furthermore, the scope of the present disclosure shall be construed to cover various modifications, combinations, alterations, etc. of the above-described embodiments, which shall be considered to be within the scope of the present invention. Accordingly, various features and characteristics of the present invention as discussed herein may be selectively interchanged and applied to other illustrated and non-illustrated embodiments of the present invention.

The invention claimed is:

1. A system for packaging products moving along a path of travel, comprising:

a product conveyor extending along the path of travel and along which the products are moved;

a frame;

an overhead lug conveyor section extending along the frame and including a lug conveyor moving along an elliptical path;

at least one cam track extending along the lug conveyor section and along the path of travel of the products; and a series of articulating lugs mounted along the lug conveyor at spaced intervals, each of the articulating lugs comprising;

a body pivotally mounted, about an axis substantially parallel to the path of travel, to a carrier and including a downwardly projecting engaging portion configured to engage at least one product of a group of products when the body is pivoted to a position to engage a packaging material received over the group of products for moving the packaging material substantially in alignment with the movement of the group of products along their path of travel by the product conveyor; and a cam rod extending from the body and adapted to engage and move along the at least one cam track for moving the body between an engaging position in operative pushing engagement with the packaging material and with the engaging portion engaging the at least one product of the group of products, to maintain and move the packaging material with the group of products, and a non-engaging position out of engagement with the packaging material and the group of products after the packaging material has been wrapped about the group of products.

2. The system of claim 1, further comprising a series of product pusher elements mounted along the lug conveyor of the overhead lug conveyor section adjacent the articulating lugs for engaging and urging the groups of products along their path of travel with the movement of the packaging material applied thereto.

3. The system of claim 1, wherein the articulating lugs are arranged in pairs with the articulating lugs of each pair mounted on opposite sides of the path of travel of the products.

4. The system of claim 1, wherein the at least one cam track comprises a first cam track extending along an upper portion of the lug conveyor section and along which the cam rods of the articulating lugs are received for maintaining the articulating lugs in their non-engaging positions.

5. The system of claim 4, wherein the at least one cam track comprises a second cam track extending along the lug conveyor and having an angled cam surface, and further comprises a transition guide for guiding the cam rods of the articulating lugs between the first and second cam tracks to cause movement of the articulating lugs between their non-engaging and engaging positions.

6. The system of claim 1, further comprising a series of folding rods mounted along the path of travel of the products, in position to engage and urge side portions of the packaging material toward a wrapping position along the groups of products.

7. The system of claim 1, further comprising a series of brackets connecting the lug conveyor section to the frame, and an actuator linked to at least one of the brackets for adjusting a position of the lug conveyor section with respect to the frame.

8. A system for packaging products moving along a path of travel, comprising:

a product conveyor extending along the path of travel and along which the products are moved;

a frame;

an overhead lug conveyor section extending along the frame and including a lug conveyor moving along an elliptical path;

at least one cam track extending along the lug conveyor section and along the path of travel;

a plurality of articulating lug assemblies mounted in spaced intervals along the overhead lug conveyor section, each articulating lug assembly of the plurality of articulating lug assemblies comprising pairs of opposing articulating lugs; and at least one product pusher element mounted substantially adjacent to at least one pair of the pairs of opposing articulating lugs, the at least one product pusher element engages and urges a set of the products along the path of travel, wherein each articulating lug of one or more of the pairs of opposing articulating lugs comprises:

a body adapted to engage a packaging material received over a group of the products and move the packaging material substantially in alignment with the movement of the group of the products along the path of travel; and a cam rod extending from the body and adapted to engage and move along the at least one cam track for guiding the body between an engaging position to engage and move the packing material with the group of products, and a non-engaging position out of engagement with the packaging material after the packaging material has been wrapped about the group of products; and wherein the at least one cam track comprises a first cam track having a first cam surface, a second cam track having a second cam surface oriented at an angle with respect to the first cam surface, and a guide track section extending between the first and second cam tracks for guiding the cam rods of the articulating lugs between the first and second cam tracks.

9. The system of claim 8, wherein the guide track section can be removed so as to cause the cam rods of the articulating lugs to be maintained along the first cam track and the articulating lugs to be maintained in their non-engaging positions.

10. A method of packaging groups of products, comprising:

moving packing material over the groups of products along path of travel;

moving articulating lug assemblies toward a set of products of the groups of products, each at least one of the articulating lug assemblies including a pair of articulating lugs each having a body pivotable between a non-engaging position and an engaging position for engaging the packing material and at least one product of the set of products as the body is pivoted toward the engaging position with the packing material projecting downwardly from the body;

engaging at least one product of the set of products with a product pusher element positioned substantially adjacent to the pair of articulating lugs to urge the set of products along the path of travel;

as the groups of products are moved along the path of travel, maintaining and moving the packing material in position on the set of products along the path of travel with the articulating lugs;

folding the packing material about the set of products; and moving the articulating lugs to their non-engaging positions out of engagement with the packing material.

11. The method of claim 10, further comprising moving the articulating lug assemblies about an overhead lug conveyor along the path of travel.

12. The method of claim 10, further comprising moving the pair of articulating lugs to the engaging position for engaging the packing material as the articulating lug assemblies moves with the set of products along the path of travel.

13. The method of claim 12, further comprising moving a cam pin mounted to at least one articulating lug of the pair of articulating lugs along a first cam track to maintain the at least one articulating lug of the pair of articulating lugs in the non-engaging position, and transitioning the cam pin to a second cam track to cause the at least one articulating lug of the pair of articulating lugs to move to the engaging position.

14. The method of claim 13, further comprising moving the cam pin of the at least one articulating lug of the pair of articulating lugs along the second cam track to maintain the at least one articulating lug of the pair of articulating lugs in engagement with the packing material as the packing material is folded about the set of products.

15. The method of claim 14, further comprising transitioning the cam pin of the at least one articulating lug of the pair of articulating lugs from the second cam track to the first cam track to move the at least one articulating lug of the pair of articulating tugs out of engagement with the packing material.

16. The method of claim 10, wherein folding the packing material about the set of products comprises engaging side portions of the packing material with folding rods positioned on each side of the product conveyor, and as the set of products move between the folding rods, urging the side portions of the packing material toward a position wrapped about the set of products.

17. An overhead packaging machine for controlling movement of packing material applied in position overlying groups of products, comprising:

a conveyor extending above a path of travel of the groups of products;

a plurality of articulating lug assemblies comprising pairs of opposing articulating lugs mounted in a substantially adjacent spaced series extending about the conveyor along the path of travel and pivotable to move along a path transverse to the path of travel toward sets of products of the groups of products;

wherein at least one articulating lug of the pairs of opposing articulating lugs comprises a body with an engaging portion projecting downwardly from the body and a cam pin projecting from an upper portion of the body and with the at least one articulating lug movable between a non-engaging position and an engaging position wherein the body is in pushing contact with the packing material applied to the set of products and the engaging portion of the body of the lug engages a lip or edge of a product of the set of products for moving the packing material in conjunction with movement of the group of products along the path of travel as the packing material is wrapped about the groups of products; and a series of cam tracks extending along the conveyor and adapted to be engaged by the cam pin of the at least one articulating lug of each of the pairs of opposing articulating lugs for controlling the position of the at least one articulating lug.

18. The overhead packaging machine of claim 17, further comprising a product pusher element for urging the product groups forwardly along the path of travel.

19. The overhead packaging machine of claim 17, wherein the series of cam tracks comprises a first cam track extending about the conveyor and having a cam surface along which the cam pin of the at least one articulating lug of the pairs of opposing articulating lugs is moved to maintain the at least one articulating lug in the non-engaging position, and a second cam track having an angled cam surface, wherein as the cam pin of the at least one articulating lug of the pairs of opposing articulating lugs is moved along the angled cam surface, the at least one articulating lug is maintained in the engaging position for contacting and moving the packing material with the set of products.

20. The overhead packaging machine of claim 19, wherein the series of cam tracks further comprises a guide track section for guiding the cam pin of the at least one articulating lug of the pairs of articulating lugs assembly between the first and second cam tracks.

21. The overhead packaging machine of claim 17, further comprising a series of folding rods mounted along the path of travel of the products, in position to engage and urge side portions of the packing material toward a wrapping position along the groups of products.

22. The overhead packaging machine of claim 17, wherein the pairs of opposing articulating lugs are pivotally mounted to a carriage mounted along the conveyor on opposite sides thereof, one or more of the articulating lugs of the pairs of opposing articulating lugs further comprising a body configured to fit about the set of products and engage the packing material applied thereto.

23. An overhead packaging machine for controlling movement of cartons applied in positions overlying groups of products as the cartons are wrapped about their groups of products, comprising:

a product conveyor along which the groups of products are moved along a path of travel;

an overhead conveyor extending along the path of travel of the groups of products;

a plurality of articulating lug assemblies mounted in spaced series along the overhead conveyor and moving along a path into engagement with the groups of products moving along the product conveyor;

wherein each articulating lug assembly comprises a pair of articulating lugs pivotally mounted on opposite sides of a carriage carried along the overhead conveyor, with each of the articulating lugs further comprising a body having a lower portion configured to fit under a lip or edge of a product of an engaged group of products, and a cam pin projecting from an upper portion of the body, wherein the pair of articulating lugs is pivotable toward the product in a direction transverse to the path of travel; and a series of cam tracks extending along each side of the overhead conveyor and each adapted to be engaged by the cam pins of the articulating lugs of each articulating lug assembly for controlling the pivoting of the articulating lugs between a non-engaging position and an engaging position wherein the bodies of the lugs are in pushing contact with the cartons applied to the engaged groups of products and the lower portions of the bodies are engaging the lip or edge of products of the engaged group of products for moving the cartons in conjunction with the movement of the engaged groups of products along the path of travel as the cartons are wrapped around the engaged groups of products.

* * * * *